US006397488B1

(12) United States Patent
Brinkly

(10) Patent No.: US 6,397,488 B1
(45) Date of Patent: Jun. 4, 2002

(54) APPARATUS AND METHOD FOR DRYING PRINTING COMPOSITION ON A PRINT MEDIUM

(75) Inventor: Richard Brinkly, Court Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 23 days.

(21) Appl. No.: 09/596,203

(22) Filed: Jun. 15, 2000

(51) Int. Cl.[7] ..... F26B 13/30

(52) U.S. Cl. ..... 34/92; 34/73; 34/79; 34/85; 34/618; 34/619; 34/620; 34/634; 34/635; 34/636; 347/102; 101/424.1; 118/50

(58) Field of Search ..... 34/73, 79, 85, 34/92, 618, 619, 620, 235; 347/102; 101/424.1; 427/372.2; 118/50

(56) References Cited

U.S. PATENT DOCUMENTS

| | | | | | |
|---|---|---|---|---|---|
| 3,986,268 | A | | 10/1976 | Koppelman | 34/1 |
| 4,194,296 | A | | 3/1980 | Pagnozzi et al. | 34/16.5 |
| 4,442,611 | A | * | 4/1984 | Gunther et al. | 34/41 |
| 4,862,599 | A | | 9/1989 | Brunner | 34/46 |
| 5,197,201 | A | | 3/1993 | Salin | 34/16.5 |
| 5,228,209 | A | | 7/1993 | Brunner | 34/16.5 |
| 5,425,182 | A | | 6/1995 | Brunner | 34/66 |
| 5,712,672 | A | * | 1/1998 | Gooray et al. | 347/102 |
| 5,979,074 | A | | 11/1999 | Brunner et al. | 34/396 |
| 6,151,796 | A | * | 11/2000 | Karamatsu et al. | 34/92 |

* cited by examiner

*Primary Examiner*—Denise L. Esquivel
*Assistant Examiner*—Greg T. Warder
(74) *Attorney, Agent, or Firm*—Erik A. Anderson

(57) ABSTRACT

An apparatus and method for drying printing composition on a print medium are disclosed. A method embodiment for use in a printing device includes depositing printing composition onto a print medium and enclosing the print medium in a sealed environment. The method additionally includes reducing a pressure in the sealed environment below an ambient pressure and heating the print medium in the sealed environment to dry the printing composition on the print medium. An apparatus embodiment for use in a printing device having a print engine for depositing printing composition onto a print medium includes an enclosure configured to provide a sealed environment around the print medium. The apparatus additionally includes a vacuum source fluidly coupled to the enclosure and configured to reduce a pressure in the sealed environment below an ambient pressure and a heater configured to apply heat energy to the print medium in the sealed environment to dry the printing composition on the print medium. Further characteristics and features of the apparatus and method are disclosed herein.

12 Claims, 3 Drawing Sheets

APPARATUS AND METHOD FOR DRYING PRINTING COMPOSITION ON A PRINT MEDIUM

BACKGROUND AND SUMMARY

The present invention relates to printing devices. More particularly, the present invention relates to an apparatus and method for drying printing composition on a print medium.

Printing devices, such as inkjet printers and laser printers, use printing composition (e.g., ink or toner) to print images (text, graphics, etc.) onto a print medium in a printzone of the printing device. Inkjet printers may use print cartridges, also known as "pens", which shoot drops of printing composition, referred to generally herein as "ink", onto a print medium such as paper, transparency or cloth. Each pen has a printhead that includes a plurality of nozzles. Each nozzle has an orifice through which the drops are ejected. To print an image, the printhead is propelled back and forth across the page by, for example, a carriage while ejecting drops of ink in a desired pattern as the printhead moves. The particular ink ejection mechanism within the printhead may take on a variety of different forms known to those skilled in the art, such as thermal printhead technology. For thermal printheads, the ink may be a liquid, with dissolved colorants or pigments dispersed in a solvent.

In a current thermal system, a barrier layer containing ink channels and vaporization chambers is located between an orifice plate and a substrate layer. This substrate layer typically contains linear arrays of heating elements, such as resistors, which are energized to heat ink within the vaporization chambers. Upon heating, the ink in the vaporization chamber turns into a gaseous state and forces or ejects an ink drop from a orifice associated with the energized resistor. By selectively energizing the resistors as the printhead moves across the print medium, the ink is expelled in a pattern onto the print medium to form a desired image (e.g., picture, chart or text).

In order for the image to be fixed to the print medium so that it will not smear, the printing composition must be dried. The printing composition is dried by a combination of the solvent evaporating and the solvent absorbing into the print medium, both of which take time. Various factors control the amount of time required for a particular printing composition to dry. These factors include the type of print medium, the quantity of solvent in an printing composition, the amount of printing composition on the print medium, and ambient temperature and humidity. Ideally, the printing composition will be fixed to the print medium quickly to help prevent image smear, print medium cockle (print medium buckle toward a printhead), and print medium curl (curling along at least one edge of a print medium), as well as to help maximize printing device throughput.

To reduce the amount of this time, the surface of some types of print media may be specially coated to help speed drying. Other means may also be used such as special chemicals, generally know as "fixers", that are applied to print media before or after printing. Pressure may also be applied, alone or in combination with heat from a heating device, to help reduce this amount of time. Various types of heating devices may also be used to heat print media before and/or after printing.

Each of these above-described techniques have certain disadvantages. For example, specially coated print media may be relatively more expensive than uncoated print media. Fixers may become depleted during printing, resulting in no fixer being applied for the remainder of a print job, possibly causing some or all of the aforementioned problems, or the stopping of a print job to supply additional fixer, resulting in decreased printing device throughput and possible color hue shift on the print medium for which printing was halted.

Pressure generating devices, such as pressure rollers, can cause image smear. Also, pressure generating devices add to the overall cost, size and complexity of the printing device.

Heating devices are often expensive to operate in those printing devices that produce large quantities of printed output. Another consequence of such high throughput printing devices that use heating devices to dry printing composition on print media is excess heat generation. If excessive, heat shielding or heat absorbing members inside the printing device may be necessary both to help protect various components of a printing device from such excess heat and to help dissipate such excess heat. Such extra components add to the overall cost, size, and complexity of the printing device.

An apparatus and method that decreased the amount of time required to dry or fix printing composition to a print medium while avoiding the above-described problems associated with other techniques would be a welcome improvement. Accordingly, the present invention is directed to drying or fixing printing composition to a print medium quickly to help prevent image smear, print media cockle, and print media curl. The present invention is also directed to helping maximize printing device throughput and minimize excessive heat generation so that the above-described wasted heat energy is avoided and heat shielding and heat absorbing members are unnecessary, thereby avoiding the above-described problems associated with such devices. The present invention is additionally directed to eliminating the need for pressure generating devices to help dry or fix printing composition to print media, thereby also avoiding the above-noted problems associated with such devices. The present invention is further directed to eliminating the need for specially coated media and fixers to accelerate drying.

Accordingly, an embodiment of a method in accordance with the present invention for use in a printing device includes depositing printing composition onto a print medium and enclosing the print medium in a sealed environment. The method additionally includes reducing a pressure in the sealed environment below an ambient pressure and heating the print medium in the sealed environment to dry the printing composition on the print medium.

The above-described embodiment of a method in accordance with the present invention may be modified and include the following characteristics, as described below. The method may further include raising the pressure in the sealed environment to the ambient pressure subsequent to heating. The method may also include capturing liquid removed from the printing composition during heating.

An embodiment of an apparatus in accordance with the present invention for use in a printing device having a print engine for depositing a printing composition onto a print medium includes structure for enclosing the print medium in a sealed environment. The apparatus additionally includes structure for reducing a pressure in the sealed environment below an ambient pressure and structure for heating the print medium in the sealed environment to dry the printing composition on the print medium.

The above-described embodiment of an apparatus in accordance with the present invention may be modified and include the following characteristics, as described below. The apparatus may also include structure for raising the pressure in the sealed environment to the ambient pressure subsequent to heating. The apparatus may also include structure for capturing liquid removed from the printing composition during heating.

An alternative embodiment of an apparatus in accordance with the present invention for use in a printing device having a print engine for depositing a printing composition onto a print medium includes an enclosure configured to provide a sealed environment around the print medium. The apparatus additionally includes a vacuum source fluidly coupled to the enclosure and configured to reduce a pressure in the sealed environment below an ambient pressure and a heater configured to apply heat energy to the print medium in the sealed environment to dry the printing composition on the print medium.

The above-described alternative embodiment of an apparatus in accordance with the present invention may be modified and include the following characteristics, as described below. The apparatus may also include a valve fluidly coupled to the enclosure and configured to raise a pressure in the sealed environment to the ambient pressure subsequent to heating. The apparatus may also include an accumulator for capturing liquid removed from the printing composition during heating.

The foregoing summary is not intended by the inventors to be an inclusive list of all the aspects, advantages, and features of the present invention, nor should any limitation on the scope of the invention be implied therefrom. This summary is provided in accordance with 37 C.F.R. Section 1.73 and M.P.E.P. Section 608.01(d). Other objects, advantages, and novel features of the present invention will become apparent from the following detailed description of the invention when considered in conjunction with the accompanying drawings.

DETAILED DESCRIPTION OF THE DRAWINGS

Figure 1:
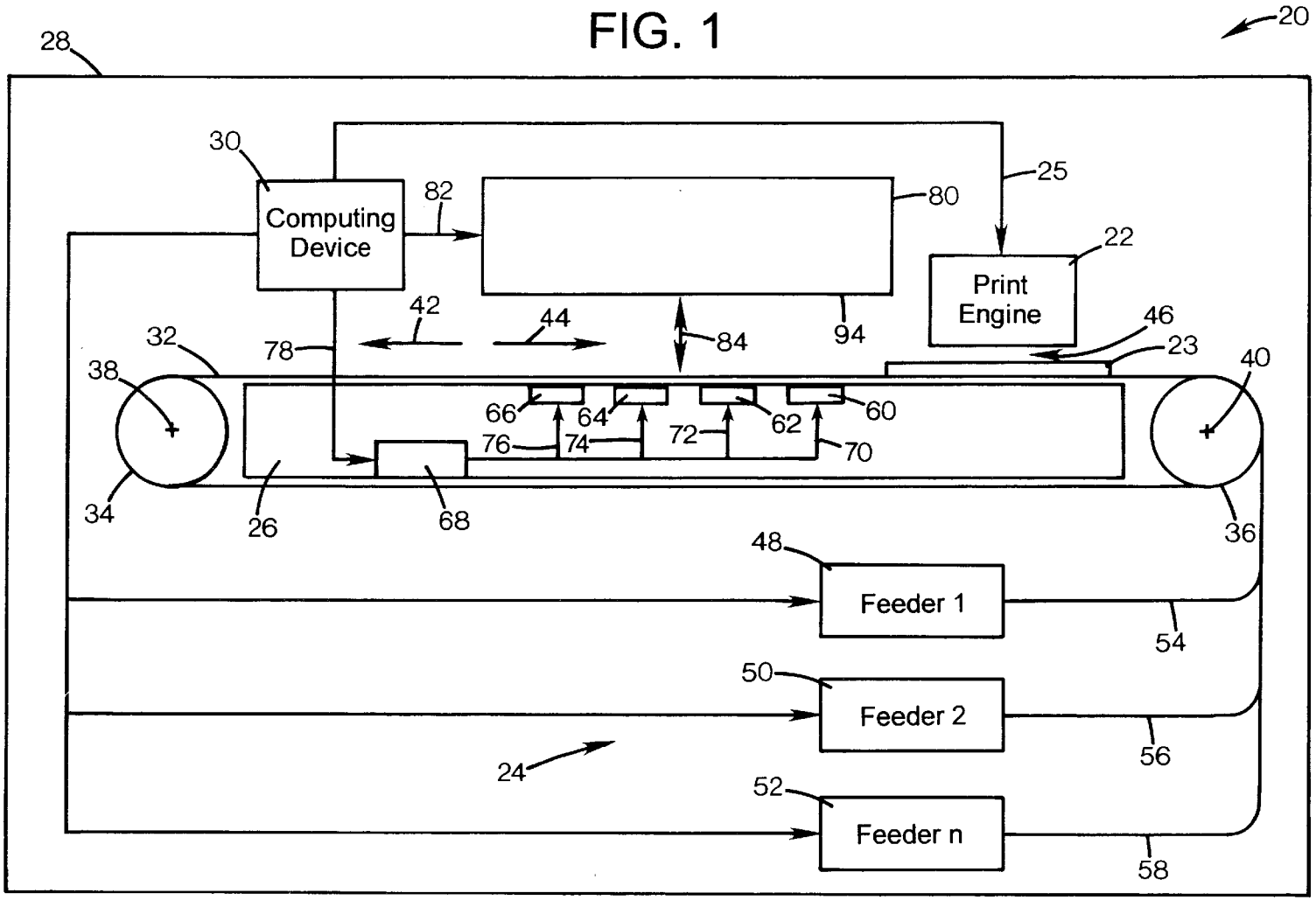
FIG. 1 is a diagrammatic view of a printing device that includes an embodiment of the present invention.

FIG. 1 illustrates a diagrammatic view of an inkjet printing device 20 that includes an embodiment of the present invention and which may be used for printing business reports, correspondence, desktop publishing, and the like. A variety of printing devices are commercially available. For instance, some of the printing devices that may embody the present invention include printers, plotters, copiers, and facsimile machines to name a few, as well as various combination devices, such as combination facsimiles and printers. In addition, the present invention may be used in a variety of types of printing devices such as inkjet printers, dot matrix printers, and laser printers.

Some of the major elements of printing device 20 are shown in FIG. 1, including print engine 22, print media handling system 24, vacuum platen 26, and housing or casing 28.

Print engine 22 may comprise any type of apparatus by which an image is recorded on print medium 23, including inkjet printing mechanisms, dot matrix mechanisms, and laser mechanisms. A computing device 30 is used to control formation of images on print medium 23 by print engine 22, as generally indicated by arrow 25. Computing device 30 often receives instructions from a host device, typically a computer, such as a personal computer (not shown). Many of the functions of computing device 30 may be performed by a host computer (not shown), including any printing device 20 drivers resident on the host computer, by electronics in printing device 20, or by interactions between the host computer and the electronics. As used herein, the term "computing device 30" encompass these functions, whether performed by a host device, printing device 20, an intermediary device between the host device and printing device 20, or by combined interaction of such elements.

Print media handling system 24 includes a belt or web transport 32 that is disposed around a pair of driven rollers 34 and 36. Rollers 34 and 36 may be selectively driven by computing device 30 of printing device 20 and one or more motors and drive gears (both of which are not shown) so as to rotate about points 38 and 40 in either a clockwise or counter-clockwise direction which allows web or belt transport 32 to selectively move in either of the directions indicated by arrows 42 and 44. Web or belt transport 32 is in fluid communication with vacuum platen 26 by, for example, a plurality of apertures (not shown) formed though web or belt transport 32. In this manner, print medium 23 is held against web or belt transport 32 for the span of the length of vacuum platen 26 and can be moved to and from printzone 46 any number of times. This span may be changed by resizing the dimensions of vacuum platen 26.

As can also be seen in FIG. 1, print media handing system 24 includes a plurality of print media feeders 48, 50, and 52. Feeders 48, 50, and 52 each include a tray for sheets of print media or a rack for a roll of print media, as well as the necessary components to transport print media to printzone 46 of printing device 20 for printing by print engine 22 via print media feed paths 54, 56, and 58. Feeders 48, 50, and 52 may each be separately configured to hold various sized print media or, alternatively, fixed sized print media. Computing device 30 of printing device 20 is also coupled to each of feeders 48, 50, and 52 to control selective transport of print media from any one of feeders 48, 50, and 52 to printzone 46 for printing of images by print engine 22. The present invention may be used with printing devices having any number of print media input trays and/or racks which is noted in FIG. 1 through the use of the designation "Feeder n" for feeder 52.

As can additionally be seen in FIG. 1, printing device 20 includes heating devices 60, 62, 64, and 66, in accordance with the present invention, positioned as shown so as to apply heat energy to print medium 23 via conduction to heat any printing composition on print medium 23, as more fully discussed below. Heating devices 60, 62, 64, and 66 receive energy from power source 68, as generally indicated by arrows 70, 72, 74, and 76 in FIG. 1. Power source 68 is controlled by computing device 30 to supply energy to heating devices 60, 62, 64, and 66, as generally indicated by arrow 78 in FIG. 1 and discussed more fully below.

Figure 2:
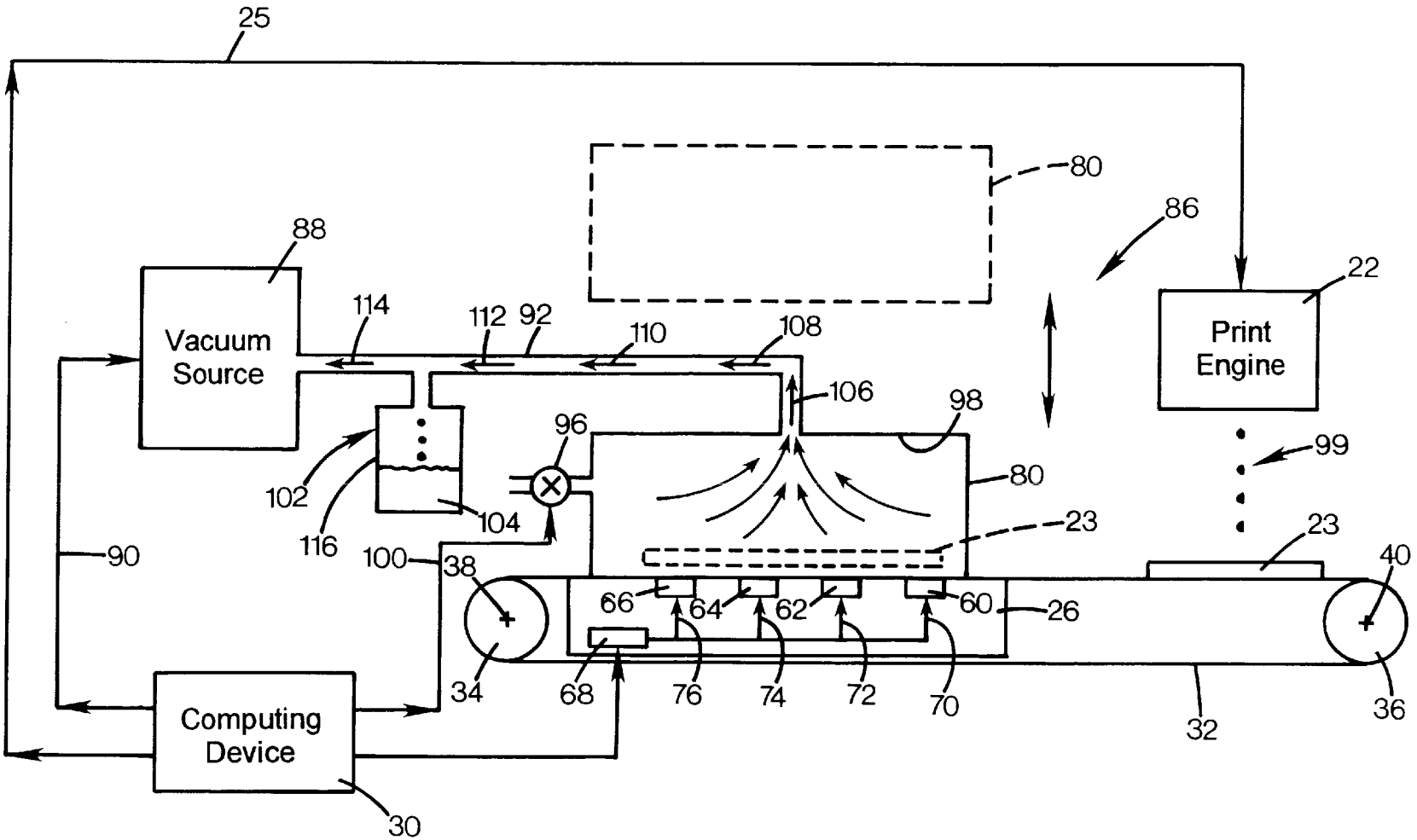
FIG. 2 is a diagrammatic view of an embodiment of a vacuum dryer in accordance with the present invention.

As can further be seen in FIG. 1, printing device 20, in accordance with the present invention, includes an enclosure 80 that is configured to provide a sealed environment around print medium 23 when lowered into position around print medium 23, as discussed more fully below in connection with FIG. 2. Enclosure 80 is controlled by computing device 30, as generally indicated by arrow 82, and can be raised by an enclosure movement mechanism (not shown) above vacuum platen 26 as shown in FIG. 1. Enclosure 80 may also be lowered by the enclosure movement mechanism (not shown) onto vacuum platen 26 to provide the sealed environment around print medium 23, as shown in FIG. 2 and discussed below in connection therewith. This ability to raise and lower enclosure 80 is generally indicated by double-arrow 84 in FIG. 1.

A diagrammatic view of an embodiment of a vacuum dryer 86 in accordance with the present invention is shown in FIG. 2. As can be seen in FIG. 2, vacuum dryer 86 includes the above-described enclosure 80 and a vacuum source 88 which is also controlled by computing device 30, as generally indicated by arrow 90 in FIG. 2. Vacuum source 88 is fluidly coupled to enclosure 80 via a conduit 92 and is configured to reduce a pressure in the sealed environment provided by enclosure 80 to below an ambient pressure surrounding vacuum dryer 86.

As can be seen in FIG. 2, enclosure 80 is configured to provide the sealed environment 98 around print medium 23 when lowed into position onto web or belt transport 32 and vacuum platen 26 so as to lie around print medium 23 as shown in FIG. 2. A gasket (not shown) made, for example, from an elastomer (e.g., rubber, silicon, etc.) may be provided around edge 94 (see FIG. 1) of enclosure 80 so as to lie between web or belt transport 32 and enclosure 80 when enclosure 80 is lowered into the position shown in FIG. 2. As also shown in FIG. 2, enclosure 80 may be configured to include a valve 96 fluidly coupled to sealed environment 98 of enclosure 80 and selectively connectable to the ambient. Valve 96 is controllable by computing device 30, as generally indicated by arrow 100, to selectively isolate sealed environment 98 of enclosure 80 from the ambient so that the pressure in sealed environment 98 may be reduced below ambient pressure to accelerate drying of printing composition 99 deposited on print medium 23 by print engine 22, as discussed more fully below. Valve 96 is also controllable by computing device 30 to connect sealed environment 98 of enclosure 80 with the ambient to raise the pressure within interior 98 to ambient subsequent to drying of printing composition on print medium 23.

As can further be seen in FIG. 2, vacuum dryer 86 also includes an accumulator 102 fluidly coupled to conduit 92 as shown. Accumulator 102 is configured to capture vapor removed from printing composition 99 on print medium in enclosure 80 during drying, in accordance with the present invention. This vapor travels with air in conduit 92 toward vacuum source 88, as generally represented by arrows 106, 108, 110, 112, and 114 in FIG. 2. Accumulator 102 is further configured to condense this vapor into a liquid 104 which is collected in vessel 116 of accumulator 102 which may be drained from time-to-time.

Vacuum dryer 86 of the present invention operates by lowering the pressure in sealed environment 98 below ambient pressure and then applying heat energy to printing composition 99 on print medium 23 via heating devices 60, 62, 64, and 66. This heat energy removes liquid solvent from printing composition 99 by turning it into a vapor, thereby drying or fixing it to print medium 23. The phase change from liquid to vapor occurs when the vapor pressure of the liquid solvent of printing composition 99 is greater than the pressure within sealed environment 98 of enclosure 80. As the pressure within sealed environment 98 is lowered in accordance with the present invention, the amount of heat energy from heating devices 60, 62, 64, and 66 required to raise the vapor pressure of the liquid solvent to the point of phase change is less than the amount of heat energy required if the pressure were not lowered. The use of less heat energy lowers the cost of operation of printing device 20. Also, printing device 20 throughput increases because less time is required to dry printing composition 99 on each sheet of print medium 23. Furthermore, the use of less heat energy may reduce or eliminate the need for heat shielding and heat absorbing members which lowers the cost of printing device 20.

Figure 3:
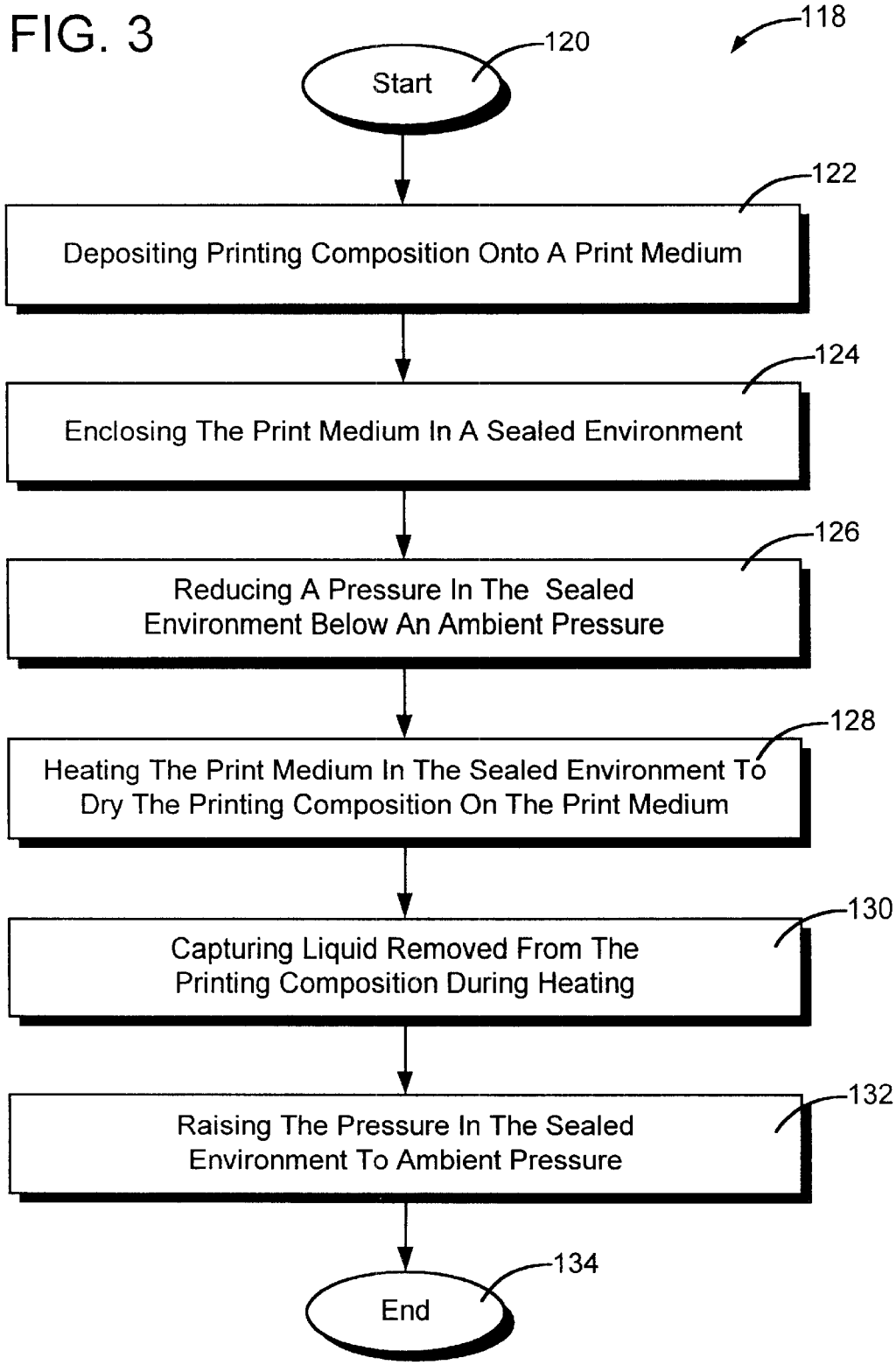
FIG. 3 is a diagram of an embodiment of a method in accordance with the present invention.

A diagram of an embodiment of a method 118 in accordance with the present invention is shown in FIG. 3. As illustrated in FIG. 3, method 118 of the present invention begins 120 with depositing printing composition onto a print medium (like print medium 23), as generally indicated by block 122. Next, method 118 encloses the print medium in a sealed environment (like sealed environment 98 provided by enclosure 80), as generally indicated by block 124. Next, the pressure is reduced in the sealed environment below an ambient pressure (by, for example, a vacuum source like vacuum source 88), as generally indicated by block 126. Next, the sealed environment is heated to dry the printing composition on the print medium, as generally indicated by block 128. Liquid solvent removed from the printing composition during heating may be captured (by, for example, an accumulator like accumulator 102), as generally indicated by block 130. Next, the pressure in the sealed environment may be raised to ambient pressure (by for example, a valve like valve 96), as generally indicated by block 132. Once this is completed, method 118 ends 134.

Although the invention has been described and illustrated in detail, it is to be clearly understood that the same is intended by way of illustration and example only, and is not to be taken necessarily, unless otherwise stated, as an express limitation, nor is it intended to be exhaustive or to limit the invention to the precise form or to the exemplary embodiment(s) disclosed. Modifications and variations may well be apparent to those skilled in the art. Similarly, any method elements described may be interchangeable with other method elements in order to achieve the same result.

For example, in alternative embodiments of the present invention, the heating device(s) may apply heat energy to the print medium by means other than conduction, such as radiation or convention. As another example, in other embodiments of the present invention, valve 96 may be eliminated and the pressure in sealed environment 98 raised to ambient by raising enclosure 80 to the position shown in FIG. 1 subsequent to heating print medium 23. The spirit and scope of the present invention are to be limited only by the terms of the following claims.

Reference to an element in the singular is not intended to mean "one and only one" unless explicitly so stated, but rather means "one or more." Moreover, no element or component in the present specification is intended to be dedicated to the public regardless of whether the element or component is explicitly recited in the following claims. Finally, no claim element herein is to be construed under the provisions of 35 U.S.C. Section 112, sixth paragraph, unless the element is expressly recited using the phrase "means for . . ."

What is claimed is:

1. An apparatus for drying printing composition that is applied to a sheet of print medium, comprising:

a movable belt member for transporting on a first surface thereof the sheet of print medium;

an enclosure member movable into and out of engagement with the first surface of the belt member to surround the sheet of print medium, thereby defining with the belt member a space that encloses the sheet; and a vacuum source connected to the enclosure for reducing below ambient the pressure in the space when the enclosure engages the belt member.

2. The apparatus of claim 1 including a vapor accumulator interconnected between the enclosure member and the vacuum source for accumulating therein vapor from the space.

3. The apparatus of claim 1 including a print engine and computing device for applying printing composition to the sheet of print medium.

4. The apparatus of claim 3 including feeder means for directing the sheet of print medium to the first surface of the belt member.

5. The apparatus of claim 4 further comprising heaters for heating the sheet of print medium that is on the first surface of the belt member.

6. The apparatus of claim 1 further comprising a vacuum platen contacting a second surface of the belt and including a vacuum source for drawing the sheet of print medium toward the belt member.

7. A method of drying printing composition that is applied to a sheet of print medium, comprising the steps of:

transporting on the first surface of a movable belt member a sheet of print medium;

moving an enclosure member into engagement with the belt member to surround the sheet of print medium thereby defining an enclosed space inside the enclosure and adjacent to the first surface; and reducing below ambient the pressure in the enclosed space.

8. The method of claim 7 including after the reducing step the steps of:

increasing to ambient the pressure inside the enclosed space; and moving the enclosure member out of engagement with the belt member.

9. The method of claim 7 including the step of drawing the sheet of print medium toward the belt member with vacuum pressure applied to a second side of the belt member.

10. The method of claim 7 including the step of heating the sheet of print medium that is on the first surface of the belt member.

11. The method of claim 7 including the step of applying printing composition to the sheet of print medium while the sheet is on the first surface of the belt member.

12. The method of claim 7 including the step of moving the belt member to transport the sheet of medium in either of two opposing directions.

* * * * *